US006062996A

United States Patent [19]

Quigley et al.

[11] Patent Number: 6,062,996

[45] Date of Patent: May 16, 2000

[54] FORMABLE SPORTS IMPLEMENT

[75] Inventors: Peter A. Quigley, Pocasset; Stephen C. Nolet, Leominster; Nicholas Grey, Marion, all of Mass.

[73] Assignee: Fiberspar, Inc., West Wareham, Mass.

[21] Appl. No.: 08/820,764

[22] Filed: Mar. 19, 1997

Related U.S. Application Data

[60] Provisional application No. 60/014,030, Mar. 25, 1996.

[51] Int. Cl.[7] ..... A63B 59/14

[52] U.S. Cl. ..... 473/563

[58] Field of Search ..... 473/563, FOR 189, 473/562, 561, 560

[56] References Cited

U.S. PATENT DOCUMENTS

| | | | |
|---|---|---|---|
| 3,638,942 | 2/1972 | Bassett | 473/562 |
| 3,934,875 | 1/1976 | Easton et al. | 473/561 |
| 4,086,115 | 4/1978 | Sweet, Jr. et al. | 473/561 |
| 4,358,113 | 11/1982 | McKinnon et al. | 473/561 |
| 4,488,721 | 12/1984 | Franck et al. | 473/563 |
| 4,504,344 | 3/1985 | Helle et al. | 156/185 |
| 4,591,155 | 5/1986 | Adachi | 473/561 |
| 5,407,195 | 4/1995 | Tiitola et al. | 273/67 A |
| 5,697,857 | 12/1997 | Christian et al. | 473/563 |

FOREIGN PATENT DOCUMENTS

| | | | |
|---|---|---|---|
| 2637228 | 7/1978 | Germany | 473/FOR 189 |

*Primary Examiner*—Mark S. Graham
*Attorney, Agent, or Firm*—Lahive & Cockfield, LLP

[57] ABSTRACT

A formable sports implement, of a fiber and resin composite construction and typically for attachment to a shaft, is capable of being formed to a selected shape using a low cost and simple procedure. Typically, the implement is preheated to a relatively low temperature, formed using low pressure, and allowed to cool. Upon cooling, the formable implement retains its shape, is capable of withstanding the forces of normal sports play, and retains advantages of composite construction.

35 Claims, 3 Drawing Sheets

FORMABLE SPORTS IMPLEMENT

This application claims the benefit of U.S. Provisional Application No. 60/014,030, filed Mar. 25, 1996.

FIELD OF THE INVENTION

This invention relates to apparatus and methods for imparting a selected shape to a sports implement. In particular, the invention concerns the structure and manufacture of a hockey blade formable to a selected curvature.

BACKGROUND

Various athletic events, including hockey, use a sporting implement such as a hockey blade on a shaft. With some structures, when the sporting implement breaks during play, it can be removed from the shaft and replaced with another sporting implement.

Despite changes and advancements in the technology of fabricating sporting shafts, many replacement hockey blades are still made of wood. This may be due to concerns regarding durability. Another reason may be the cost associated with forming the blade into the particular shapes desired by a player.

Wooden hockey blades typically consist of plies of wood and of glass fabric. The plies are laminated together using polymer resins, and are shaped in wooden or epoxy forms. The shape or curve of the form determines the curvature of the hockey blade.

A known composite hockey blade, on the other hand, is manufactured with a high-temperature and high-pressure molding procedure. The manufacturing process uses a mold that determines the geometry of the finished implement. Hence, a manufacturer employs a specific unique mold to form a blade with a specified curvature. This process is costly, because the price of one mold, capable of forming only one curvature, is high. Therefore, despite the shortcomings of wooden sporting implements, which vary in strength and are short lived under normal competitive use, many replaceable hockey blade implements used today are made of wood. Advances in the manufacture of tubular shafts have not been matched by similar advances in the replaceable blades.

For example, Tiitola et al., U.S. Pat. No. 5,407,195, describes a composite hockey blade formed of fiber reinforced plastics. Hockey blades formed in accordance with the Tiitola teaching are costly to produce, in part at least because of the expenses associated with forming hockey blades of different curvatures.

Sports enthusiasts often request athletic equipment customized to meet a particular need or preference. Tennis racquets, golf clubs, and other sporting implements are available in a variety of shapes, sizes, and weights. For instance, a hockey player often demands a unique curve in the blade of the hockey stick.

Accordingly, one object of this invention is to provide a structure and a manufacturing process for a sports implement that can readily be formed or shaped, including by or for each user.

A more particular object includes providing an affordable, lightweight and strong composite hockey stick blade that is readily curved to the particular shape deemed advantageous by the hockey player.

Another object of the invention is to provide a relatively simple and low-cost method for fabricating a composite hockey stick blade that can readily be formed to a desired shape.

Yet another object of the invention is to provide a structure and manufacture for a formable hockey blade that is strong enough to withstand the rigors of play without undue breaking.

Other objects of the invention will in part be obvious and will in part appear hereinafter.

SUMMARY OF THE INVENTION

The invention achieves the foregoing and other objects by providing a formable sports implement, such as a hockey stick blade, and a method for manufacturing the formable sports implement. The apparatus and the method involve providing a fiber reinforced polymer resin structure formable at a predetermined elevated temperature range dependent upon a characteristic of the polymer resin.

In particular, the blade structure employs formable materials, including a polymer resin that, upon selected heating, becomes formable, using relatively low pressure, to a selected curvature or other shape. The structure retains the selected shape upon cooling to normal ambient temperature.

Significantly, relatively low elevated temperatures and low pressures are sufficient to form the sports implement to a desired curvature, and the curve-forming procedure is relatively simple and does not require costly tools. One practice of the invention enables a manufacturer to fabricate a single, standard, non-curved formable sports implement for marketing to multiple retailers. Each retailer can perform a curve-forming or other shaping procedure as specified by each athlete. Once heated and cooled as part of the forming procedure, the sports implement is shaped to suit the individual user and yet is strong enough to withstand many rigors of athletic competition. In comparison, prior art techniques require a manufacturer to fabricate a unique mold for each potentially desirable curvature of the sports implement.

In one aspect, the sports implement of this invention is substantially formable at temperatures exceeding the glass transition temperature of the polymer resin, i.e., those temperatures where the polymer resin changes from a hard and relatively brittle condition to a viscous or rubbery condition. The sports implement is formable to a selected curvature when heated to a temperature exceeding the glass transition temperature of the polymer resin, and retains the selected curvature after the implement is cooled. Furthermore, the sports implement can include a polymer resin modified with an elastomeric compound that selectively modifies the glass transition temperature of the polymer resin.

Accordingly to a further aspect of the invention, the sports implement is made of a composite of polymer resin and fiber selected so that the sports implement becomes formable at a temperature increment above the glass transition temperature of the polymer resin. The temperature increment can range between 20 degrees–60 degrees Fahrenheit above the glass transition temperature. Preferably the sports implement becomes formable at 40 degrees above the glass transition temperature of the polymer resin material. One type of polymer resin useful in the fabrication of a formable blade structure has a glass transition temperature below 212 degrees Fahrenheit, and the temperature to which the blade structure is rapidly heated for shaping need not exceed 250 degrees Fahrenheit.

The polymer resin for the practice of the invention can be either a thermoplastic resin or a thermoset resin. A thermoset resin is fairly rigid at normal ambient temperatures but can be softened by heating to above the glass transition temperature. A thermoplastic resin, on the other hand, can be heated and softened innumerable times without suffering any basic alteration in its characteristics. Thus, a sports implement including a thermoplastic resin can be heated and formed to a selected shape repeatedly.

Preferably, the blade structure is fabricated of a multilayer element surrounding a core. The multilayer element can have fibrous sheet elements, each formed of one or more plies of fiber or fiber-reinforced resin and each disposed at one face of the blade structure. The fibrous sheet elements aid the curve-forming process and add to the structural integrity of the resulting blade. As those skilled in the art will appreciate, the structure and composition of the fibrous sheet elements can vary considerably.

A core element for a blade structure according to the invention can include a structural frame and an insert and can be positioned between two opposed fibrous sheet elements. The frame has a cavity or opening for receivably seating the insert. The sheet elements are then contiguous with opposed surfaces of both the frame and the insert.

The fibrous sheet elements can employ many different types of fiber, such as glass, carbon, aramid, polyethylene, polyester, and mixtures thereof. Further, each fibrous sheet element can be a preformed fabric, e.g., woven or braided, or essentially non-woven, e.g., of a stitched or knitted structure.

In one practice of the invention, a blade structure is fabricated with fibers oriented at a selected angle relative to an axis of the structure. Also, sets of fiber, which constitute a fibrous sheet element, are oriented at a specific angle to each other. In one illustrative example, a fabric having two sets of fibers, each set with substantially parallel fibers and each fabric woven with the fiber sets orthogonal to one another, is disposed in the blade structure, with the two fiber sets oriented at selected angles relative to the axis of the blade structure.

In another aspect of the invention, the structural integrity of the sports implement is improved by orienting a group of fibers at a particular angle. In one practice, at least a majority of the fibers are oriented at an angle of greater than ten degrees to the longitudinal axis of the blade structure. This orientation of the fibers advantageously prevents the fiber and resin structure from buckling during forming or shaping. Buckled fibers weaken the resultant structure.

A considerable body of knowledge exists, and is understood by those of ordinary skill in the art, on enhancing torsional rigidity, structural stiffness, impact resistance, and wear resistance of a structure. This known knowledge includes designing a multilaminate of various layers of particular fibers, and choosing the angular orientations of those fibers. Applying this body of knowledge to attain a particular multi-ply sheet element of a formable blade structure, or to attain a core or frame member having layers of fibrous fabrics, is deemed within the scope of the invention and, in view of the teachings herein, can be readily accomplished by one of ordinary skill in the art.

The blade structure of the invention can include an attachment that is shaped to facilitate mounting the blade on a hockey stick shaft. The attachment can telescopically insert into a cavity in a hockey stick shaft, or the attachment can include a cavity into which the shaft telescopically inserts. One attachment known in the art is a hosel. Integrating the blade structure with a shaft, wherein the blade is not replaceable, is also within the scope of the invention.

In one practice of the invention, the polymer resin of the blade structure is partially cured prior to the final forming to a desired shape. That is, the blade structure is placed in a heated cavity mold and maintained under elevated pressure and temperature for a time to achieve a B-Stage cure of the polymer resin.

Generally, those skilled in the art are familiar with curing a polymer resin to an A-stage, a B-Stage, or a C-stage. An A-stage cure refers to a resin cured to the extent that it does not flow like a liquid, but is tacky to the touch at normal ambient temperature; B-Stage refers to a resin cured such that it is not tacky to the touch at normal ambient temperature, but it will flow at elevated temperatures; C-stage is essentially a fully cured resin. Normal ambient temperature refers to the temperatures encountered in natural ambient conditions and includes the temperature range over which the sports implement is normally used.

In a preferred practice, a polymer resin component of the blade structure is cured to a B-Stage. Subsequent heating of the blade structure cured to a B-Stage renders the resin malleable, and relatively low pressure is sufficient to form the blade to a desired shape. The blade is best formed by maintaining that pressure until the blade cools. Upon cooling, the blade retains the curvature or other shaping imparted to it, and yet is strong.

Note that the molding process used to initially fabricate the blade need not impart a curvature to the blade. Only one manufacturing mold is required, and the blade typically emerges from that mold with a substantially straight configuration. As such, the blade can be supplied to hockey stores that will then tailor the shape of the blade by rapidly heating it and applying pressure to shape it to suit a particular hockey player's needs, thereby avoiding the expense of a unique mold for each unique shape of a blade.

In another practice of the invention, the blade structure is assembled in the manufacturing mold, and polymer resin is added to the blade structure using a method known in the art as resin transfer molding.

The invention also provides a method for fabricating a formable blade structure, and a method for imparting the desired curvature or other shape to the formable blade structure. The method is practiced in accordance with the embodiments disclosed herein.

DESCRIPTION OF ILLUSTRATED EMBODIMENT

Figure 1:
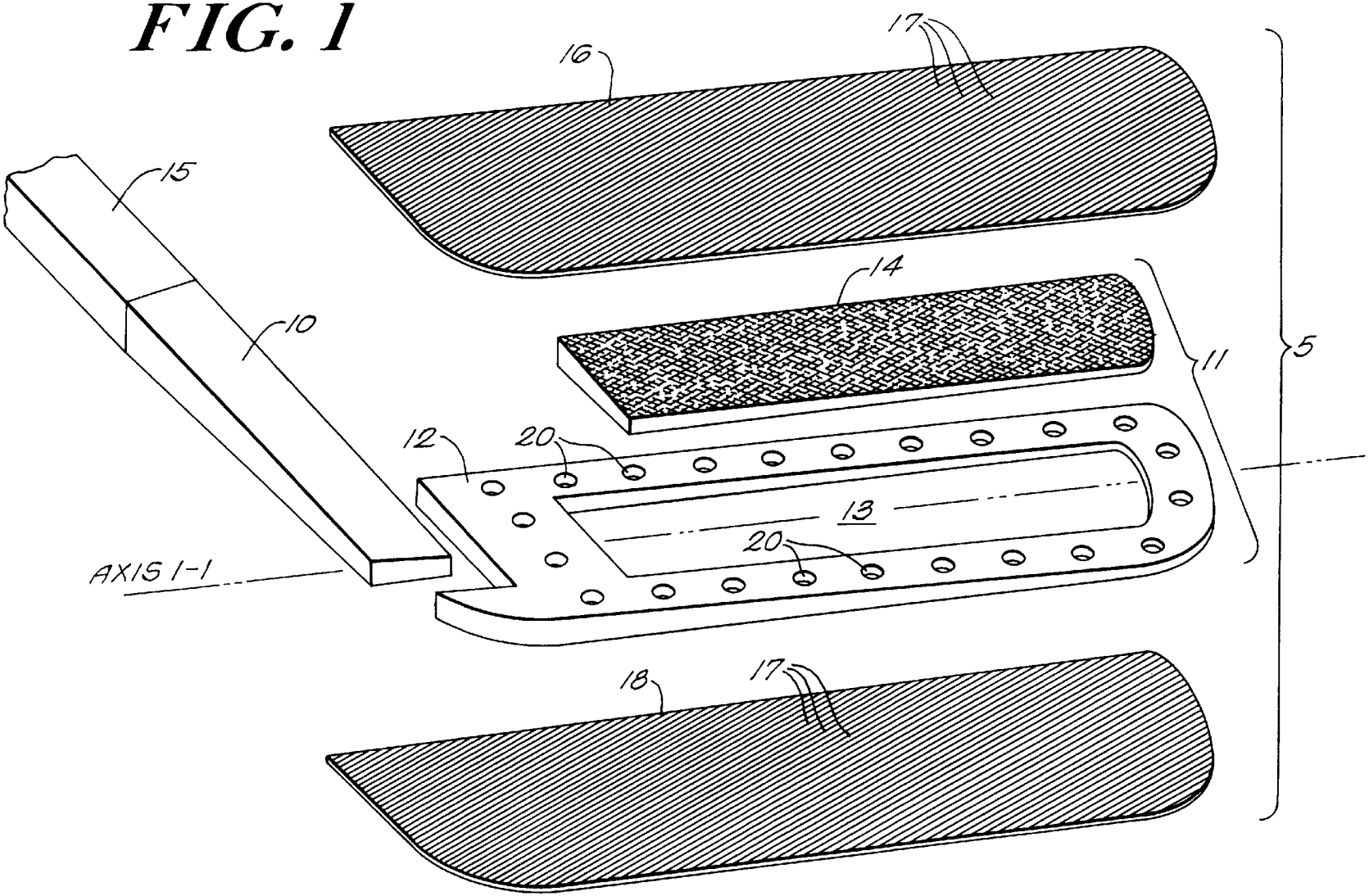
FIG. 1 is a perspective, exploded view of a formable sports implement according to the invention.

FIG. 1 illustrates a preferred embodiment of a formable hockey stick blade structure 5. The blade structure in FIG. 1 comprises a core 11, which includes a frame 12 and an insert 14, and opposing fibrous face sheet elements 16 and 18. Also included in the blade structure depicted in FIG. 1 is an attachment 10 for securing the blade to a hockey stick shaft 15. Attachment 10 is known in the art as a hosel. The frame 12 has an opening 13 for receivably seating the insert 14. A polymer resin impregnates the face sheet elements, including the spaces between fibers thereof and the fibers themselves, and impregnates (i.e., generally contacts) all the components of the blade structure 5. The resin, when cured, thus secures and bonds the components together.

The fibrous face sheet elements 16 and 18 enhance the structural integrity of the blade structure. The fibers 17 of the face sheet elements can include glass, carbon, aramid, nylon, kevlar, or polyester, and equivalents. In the embodiment illustrated in FIG. 1, the fibers 17 in each face sheet element 16 and 18 generally extend parallel to each other within that sheet element. Furthermore, the fibers in sheet element 16 are parallel to those in sheet element 18. In effect, face sheet element 16 is a mirror image, across the midplane, of face sheet element 18. The midplane is defined as the plane that contains a longitudinal axis 1—1 of the implement 5, that bisects the blade structure 5, and that is generally parallel to the faces of the sheet elements 16 and 18.

Fibrous sheet elements 16 and 18 can be symmetrically or asymmetrically disposed. As used herein, a symmetric disposition of the face sheet element fibers occurs when one face sheet is a mirror image, across the midplane, of the opposing face sheet.

However, the fibers in face sheet elements 16 need not be parallel to those in face sheet element 18. It is known in the art that advantages in certain applications result from disposing the fibers at unequal angles, or equal but opposite angles, to the longitudinal axis of the blade structure. For example, disposing the fibers in face sheet 16 at an angle of 45 degrees to the longitudinal axis and disposing the fibers in face sheet element 18 at an angle of minus 45 degrees to the longitudinal axis can have advantages, and is referred to herein as an asymmetric disposition of the fibers of the sheet elements. The definition of asymmetric encompasses any disposition of fibers in which face sheet element 16 is not a mirror image of face sheet element 18; as used herein asymmetric is not understood to be limited to the case where fibers in opposing sheet elements are at angles of equal magnitude but opposite sign (e.g., 45 degrees and minus 45 degrees). The present invention is understood to include both symmetric and asymmetric dispositions of face sheet elements 16 and 18.

The face sheet elements 16 and 18 can each comprise a fiber and resin laminate having one ply or having multiple plies. For example, sheet element 16 can have only one ply of fibers embedded in resin, or sheet 16 can have multiple distinct plies of fibers embedded in resin with each successive ply being layered on top of the preceding plies. Moreover, each ply within face sheet element 16 can have fibers oriented differently with respect to the fibers in other plies.

Woven, braided, stitched, knitted, biaxial braided and triaxial braided fibrous face sheet elements are also within the scope of the invention. A woven, braided, stitched, or knitted face sheet element generally includes sets of fibers wherein within a given set the fibers are substantially parallel to one another. Woven face sheet elements generally have at least two sets of fibers, and the fibers of a first set can be, for example, disposed at an angle of approximately 90 degrees to a second set of fibers. Additional fibers may also added to the face sheet element as stitching fibers. Many variations are known to be useful by those of ordinary skill in the art, including using different types of fibers, i.e., mixing aramid and glass fibers, within the same face sheet element.

Note that the concept of asymmetric and symmetric dispositions of sheet element fibers applies also to all sheet element compositions. In a symmetric disposition, the ply or layer of sheet element 16 closest to the midplane is a mirror image, across the midplane, of the ply of sheet element 18 that is closest to the midplane. The second closest ply of sheet element 16 is a mirror image of the second closest ply of sheet element 18, and so on. Again, the invention is understood to encompass both symmetric and asymmetric dispositions of fibers in the sheet elements.

Figure 2:
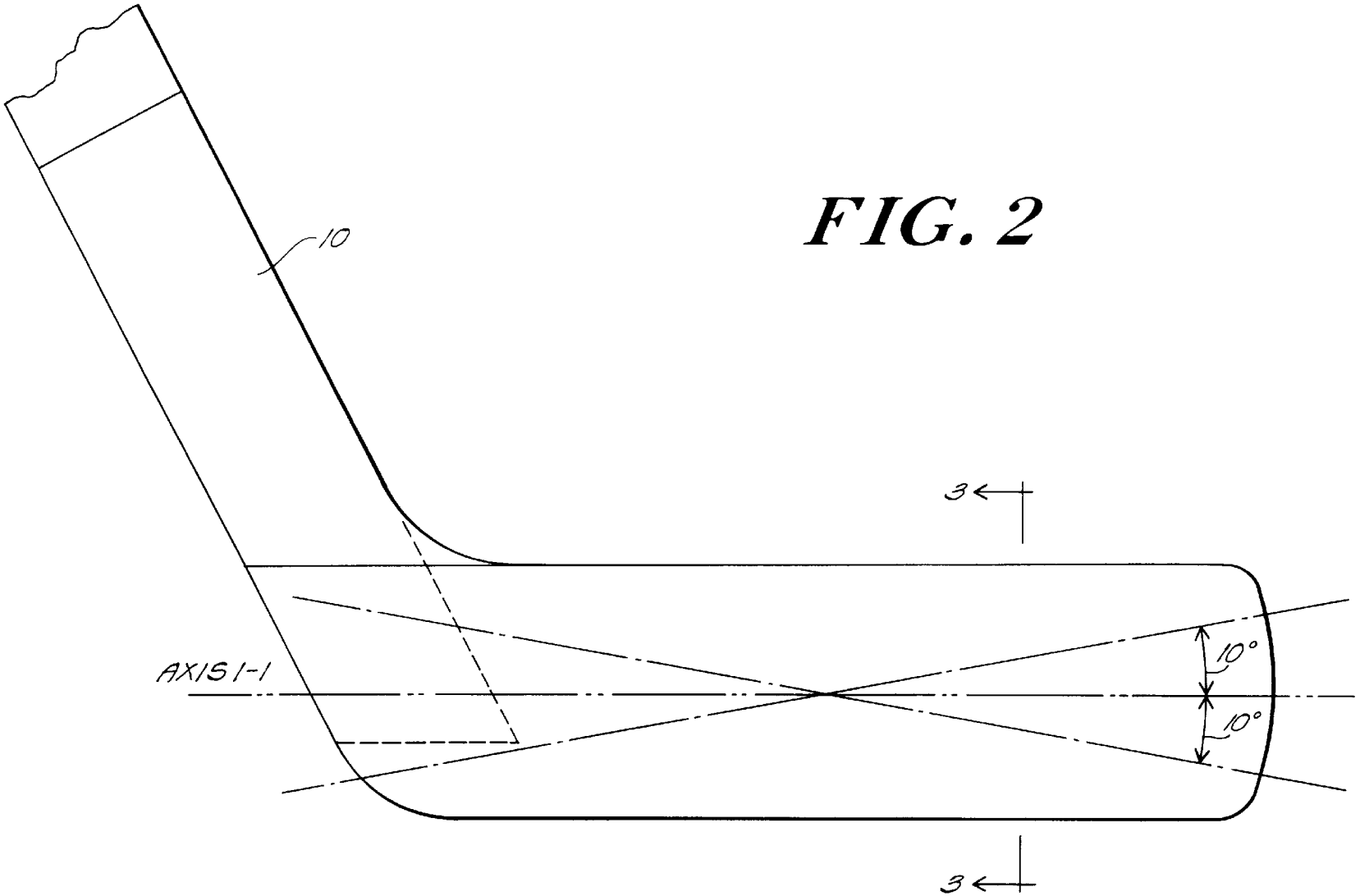
FIG. 2 is a side elevation view of the formable sports implement of FIG. 1, depicting a ten-degree offset of fiber from the longitudinal axis.

Regardless of the number of plies in the face sheet elements and the particular orientation of the fibers therein, in the preferred embodiment illustrated in FIG. 1, a majority of the fibers in the face sheet elements are oriented at an angle of greater than plus or minus 10 degrees to the longitudinal axis of the blade structure. FIG. 2 illustrates the longitudinal axis (or first axis 1—1, and two ten degree cones, one to each side of the longitudinal axis. Ideally, less than 10 percent of the fibers are oriented at angles within this cone. Orienting the fibers in this manner advantageously prevents substantial buckling of the fibers in the blade structure during the process of forming the blade to the desired curvature. In particular, when a blade is curved the outer face of the blade obtains a longer radius relative to the radius of the inner face of the blade. Accordingly, those fibers running along the inner face of the curved blade must bend more than those fibers running along the outer face of the blade. That is, the fibers running along the inner face of the bend become compressed and tend to buckle under the strains imposed during the curving process, and the fibers running along the outer face of the bend tend to slide under the tension imposed during the curving process. If, however, the fibers forming the sheet elements are oriented such that a substantial majority of them form an angle relative the first axis greater than 10 percent, the fibers on the inner face do not tend to buckle and the fibers on the outer face do not tend to slide. Accordingly, the preferred embodiment of the invention incorporates fibers oriented in this manner to prevent buckling and sliding of the fibers.

In another embodiment of the blade structure, reinforcing fibers can be employed in the fabrication of a composite hosel 10 in FIG. 1. The fibers are formed around a foam core via biaxial or triaxial braiding, or alternatively, can be used with woven or stitched fabrics. The resulting composite hosel is assembled with the other components in a mold and impregnated simultaneously with those components during injection of the polymer resin. Polymer resin injection is described below, as part of a discussion of a method of making the invention.

In the particular embodiment illustrated in FIG. 1, the core 11 comprises a frame 12 and an insert 14. The insert is end-grain plywood and the frame 12 is a high strain-to-failure thermoplastic. The thermoplastic frame supports the other components of the blade structure 5 and provides good wear and abrasion resistance. The insert serves to reduce the weight of the blade structure. For example, a plywood insert having a lower density than thermoplastic creates a blade structure 5 having a lower relative weight than a fully formed core without an insert. End grain plywood, in which the grain is directed through the thickness the plywood, is very pliable along an axis parallel to the thickness of the plywood. Accordingly, the plywood insert readily bends to accommodate selected curvatures of the blade structure 5. Other suitable materials for the core 11 include thermoplastic, fiber-reinforced thermoplastic, thermoset resin, fiber reinforced thermoset resin, wood, plywood, or a hybrid thereof.

As further illustrated in FIG. 1, the core 11 can be drilled with holes 20. For instance, holes 20 can be drilled through either the frame 12 or the insert 14. The holes are drilled perpendicular to planes of the face sheet elements 16 and 18. The diameter of the holes can range from 1/32" up to 1/2". The center-to-center spacing of the holes can range from 1/4" for holes of 1/32" diameter to 2" for holes of ½" diameter. The holes are filled with a polymer resin, or a fiber reinforced polymer resin. The polymer resin or fiber reinforced resin in the holes 20 functions as rivets 34, as shown in FIG. 4A, to tie the face sheet elements 16 and 18 together. The presence of rivets 34 improves the transverse sheer strength of the blade without measurably increasing the weight of the overall blade structure.

In another embodiment, the rivets 34 are fiber reinforced. Suitable reinforcing fibers are glass, carbon, aramid or other similar fibers. The purpose of the fibers is to further improve the strength of the blade structure.

Also within the scope of the invention is modifying the core 11 or face sheet elements 16 and 18 of the blade structure to create regions of a modified density. Regions of modified density are used to tailor the torsional rigidity, structural stiffness, or weight distribution of the blade structure, as well as of the entire blade structure and hockey stick shaft combination. One reason for creating regions of modified density is to affect the overall playability or "feel" of the hockey stick. "Feel" is not a readily quantifiable concept, but as any sports enthusiast who participates in sports play knows, the "feel" of a tennis racquet, golf club or hockey stick can greatly affect the participant's ability to repeatedly and precisely execute a desired shot. Thus "feel" involves the reaction conveyed to the player's body as the sports implement in question is used to execute a shot. Creation of regions of lower density changes the flex of the blade structure, and therefore the amount of time the puck stays in contact with the structure, hence affecting both the "feel" of the blade and the momentum imparted to the puck.

One method of creating regions of lower density is the inclusion of foam strips, such as a polyurethane foam strips, in the core; another method is including thermoplastic microspheres in the in the face sheet elements, or anywhere within the blade structure. Such microspheres are known to those skilled in the art and are available from vendors. The use of microspheres and of foam strips is disclosed in U.S. Pat. No. 5,407,195.

In a further embodiment, an entire hockey stick including a shaft 15 and a blade structures is fabricated as one component. The shaft 15 is mounted to the blade structure 5 using techniques known in the art. For example, a hosel 10 can be used to integrally mount the shaft with the blade structure. In this variation the hosel 10 can be made of materials including, but not limited to, the following: composites, fiber-reinforced composites, wood, wood laminate, aluminum, or metal alloys. In this embodiment, the fabricated hockey stick does not have a replaceable blade.

In the preferred embodiment, formulation of a polymer resin with the proper characteristics for a formable blade (i.e. a suitably low glass transition temperature and an acceptable bonding strength) is achieved by curing the resin to a Stage B cure, after initial application of the resin to the other components of blade structure 5 depicted in FIG. 1.

Figure 3:
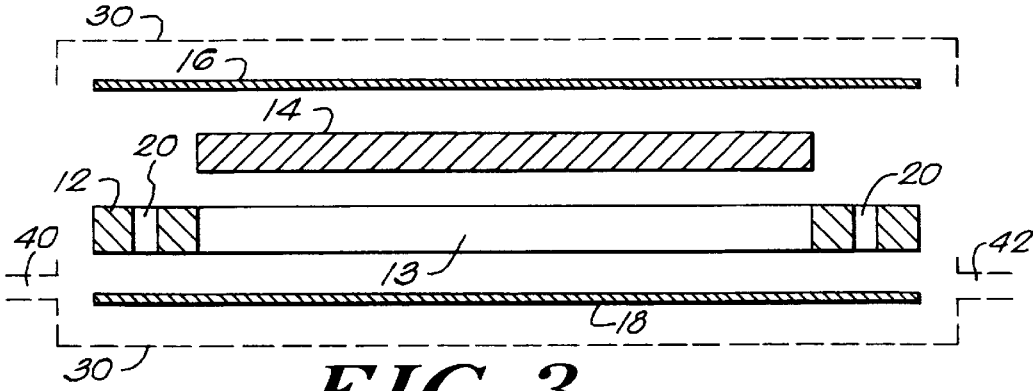
FIGS. 3–5 illustrate process steps used to fabricate the formable sports implement of FIG. 1.
Figure 4:
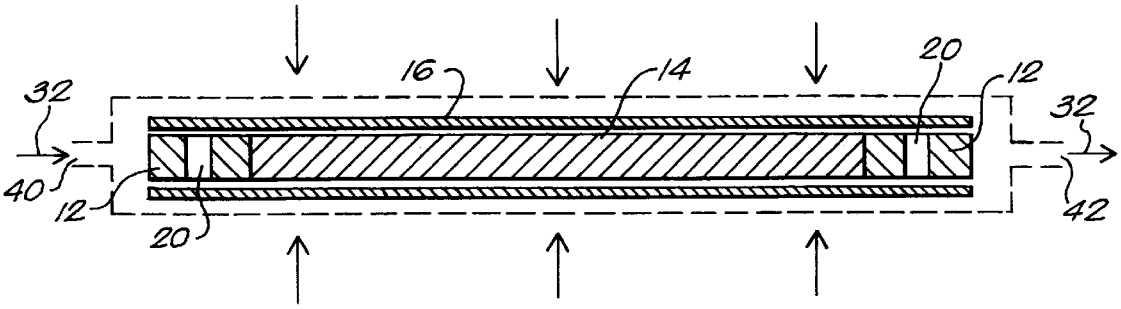
Figure 4A:
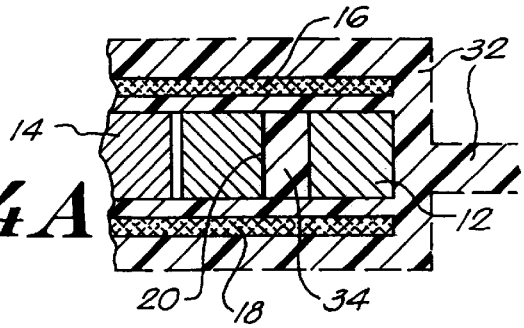
Figure 5:
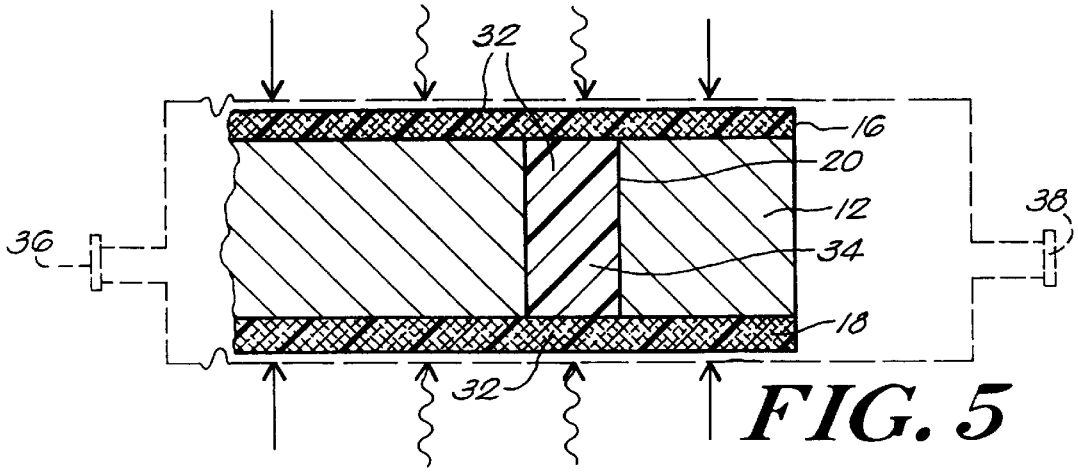

FIGS. 3–5 depict a resin transfer molding process for fabricating a formable blade structure 5. The blade structure 5 is shown in a sectional view taken along section line 3—3 of FIG. 2. The components shown in FIG. 1, namely, the hosel 10, the frame 12, the insert 14 and the face sheet elements 16 and 18, are assembled into a two-piece mold 30. FIG. 3 illustrates a mold with the two halves separated, and an exploded view of unassembled components of the blade structure 5.

FIG. 4 shows an assembled blade structure 5, with the two halves of the mold closed. After assembling the blade structure 5 and closing the mold 30, a polymer resin 32 is injected through gate 40 by mold 30. An air vent 42 allows trapped air to escape, thereby reducing the possibility of voids in the formable blade structure. Some resin 32 may also exit the vent 42. After the air has escaped, the vent 42 is sealed, and pressure is applied at port 40 to maintain the resin at a selected elevated pressure. The selected elevated pressure can range from 10 to 100 psi. The resin 32 impregnates the fibrous sheet elements 16 and 18 and generally surrounds and contacts all the other components of the blade structure. Polymer resin 32 also fills holes 20 in FIG. 1, creating rivets 34.

FIG. 4A depicts a rivet 34 in detail, and illustrates resin 32 surrounding all the components of the blade structure. The polymer resin can be fiber-reinforced, as is known in the art, via the inclusion of short fibers in the resin. Alternatively, fiber-reinforcing rivets 34 can be manufactured by first filling the holes 20 with short fibers and by subsequently injecting resin into the fiber filled holes 20.

FIG. 5 depicts heating the mold to partially cure the blade structure 5. Typically, the mold can be heated to a predetermined temperature for a selected period of time. The straight arrows depicted in FIG. 5 additionally illustrate optional pressurizing of the polymer resin. The serpentine arrows signify the practice of heating the mold. The corks 36 and 38 illustrate the sealing of air vent 42 and the cessation of resin flow into the mold 30 through port 40.

The blade structure 5 remains in the mold only until the polymer resin becomes partially cured (e.g. to a cured B-Stage). At this point, the blade structure is removed from the mold and is a complete formable hockey blade.

Important to the practice of the illustrated embodiment is a polymer resin 32 that is readily curable to a B-stage. The preferred embodiment of the invention uses a thermoset epoxy resin. Alternative embodiments, however, can use of other resins, such as thermoset resins including vinyl ester and polyester, and thermoplastic resins such as nylon and polypropylene. The polymer resins used are selected for their temperature characteristics and their elasticity. For instance, the resin might be selected such that the blade structure manufactured as described above is formable at temperatures exceeding a normal ambient temperature such as room temperature or at temperatures exceeding 100 degrees Fahrenheit.

The preferred polymer resin 32 is modified with elastomeric compounds. Elastomers (defined as a polymer possessing elastic or rubbery properties) are added to the polymer resins used in forming the blade structure in order to adjust the temperature characteristics, durability, elasticity, and structural strength of the overall blade structure. Generally, the elastomers are added, as is known in the art, to reduce the glass transition temperature of the polymer resin, thereby making the blade structure particularly easy to reform at temperatures below 250 degrees Fahrenheit. In the preferred embodiment, the glass transition temperature of the stage B resin compound does not exceed 212 degrees Fahrenheit, and the glass transition temperature of the fully cured resin does not appreciably exceed 250 degrees Fahrenheit. Examples of useful elastomers include styrene-butadiene rubbers, ethylene-propylene rubbers, butyl, polysulfide rubbers, silicones, polyacrylates, fluorocarbons, neoprene, nitrile rubbers, and polyurethanes.

Typically, the mold 30 is a cavity mold, known to those of ordinary skill in the art. The parameters of the molding procedure, such as the temperature to which the mold 30 is heated and the amount of time the blade structure 5 is left in the mold, depend on the formulation of the polymer resin and are readily determinable by one of ordinary skill in the art acting in accordance with the teachings herein.

Note that the mold 30 need not impart a curvature to the blade structure. The blade structure essentially can be straight, aligned with the longitudinal or first axis.

After the molding procedure described above, the formable blade structure 5 now can be supplied to hockey stores or customers, or formed by the manufacturer of the blade. The formable blade is fairly rigid at normal ambient temperature and appears as depicted in FIG. 2 (ignoring the cross hatch lines depicting the two ten degree cones in FIG. 2). The blade is a single unit, that is, the hosel 10, the frame 12, insert 14, and sheet elements 16 and 18 are bonded together by the Stage B resin 32. The sheet elements 16 and 18 are impregnated with the cured resin 32, and the resin 32 generally contacts all of the components of the blade. Rivets 34, fabricated in accordance with procedures described above, enhance the strength of the blade structure 5.

To impart a curvature to the blade, the blade is rapidly heated, for example in an oven, to a temperature of 250 degrees Fahrenheit. The blade is then put on forms, which need not be heated, and pressure applied to make the blade conform to the shape of the form. A forming station can consist of an oven and a set of hardwood forms.

The pressure applied to the forms can be quite low. Atmospheric pressure is sufficient. A vacuum bag form, known to those of ordinary skill in the art, is useful in imparting a curvature to the blade structure. The temperature to which the blade is heated prior to forming should be at least 40 degrees Fahrenheit higher than the glass transition temperature of the stage B polymer resin.

The blade is kept in the forms until it has fully cooled back to room temperature. Typically, 5 minutes is sufficient. At this point it is removed. The blade structure will retain its curvature and be strong enough to withstand the rigors of hockey play.

Having described the invention, what is claimed as new and secured by Letters Patent is:

1. In a sports implement for attachment to a shaft, said implement being elongated along a first axis and having an attachment for assembly with the shaft, the improvement comprising a blade structure having a center plane extending along said first axis and of formable material including a polymer resin and fibers, said blade structure including a core element and a multilayer element extending along said first axis, said multilayer element including at least a portion of said fibers and said resin, said core element including an elongated insert and a peripheral frame member located in said center plane of said blade structure, said peripheral frame member defining an elongated opening in said center plane and said elongated insert being receivably seated within said elongated opening, and said blade structure being substantially non-deformable at a first temperature, said first temperature depending upon a characteristic of said polymer resin, and being formable at a second temperature greater than the first temperature and less than 250 degrees Fahrenheit.

2. In a sports implement according to claim 1, the further improvement wherein said first temperature is normal ambient temperature.

3. In a sports implement according to claim 1, the further improvement wherein said first temperature is 100 degrees Fahrenheit.

4. In a sports implement according to claim 1 the further improvement wherein said polymer resin is a thermoset resin.

5. In a sports implement according to claim 1 the further improvement wherein said polymer resin is a thermoplastic resin.

6. In a sports implement according to claim 1, the further improvement wherein said characteristic of said polymer resin is a glass transition temperature below 212 degrees Fahrenheit.

7. In a sports implement according to 6, the further improvement wherein said polymer resin includes an elastomeric compound for lowering the glass transition temperature of said polymer resin.

8. In a sports implement according to claim 1, the further improvement wherein said multilayer element comprises first and second fibrous sheet elements contiguous respectively with first and second opposed faces of said core element, said first and second fibrous sheet elements including first and second sets of fibers impregnated with resin, respectively.

9. In a sports implement according to claim 8, the further improvement wherein said first and second sets of fibers are symmetrically oriented with respect to a mid-plane of said core element located parallel to said faces of said core element.

10. In a sports implement according to claim 8, the further improvement wherein said first and second sets of fibers are asymmetrically oriented with respect to a mid-plane of said core element located parallel to said faces of said core element.

11. In a sports implement according to claim 1, the further improvement wherein said frame is positioned between a first and a second fibrous sheet element of said multilayer element.

12. In a sports implement according to claim 11, the further improvement wherein said insert is selected from the group of materials consisting of thermoplastic, fiber reinforced thermoplastic, thermoset plastic, fiber reinforced thermoset plastic, wood, plywood, and polymer resin foam.

13. In a sports implement according to claim 1, the further improvement wherein said fibers of said multilayer element are oriented at an angle of approximately forty-five degrees relative to said first axis.

14. In a sports implement according to claim 1, the further improvement wherein a major portion of said fibers of said multilayer element are oriented at an angle offset from said first axis by at least ten degrees.

15. In a sports implement according to claim 1, the further improvement comprising a plurality of holes extending within said multilayer element and filled with polymer resin.

16. In a sports implement according to claim 15 the further improvement wherein said polymer resin in said hole includes reinforcing fibers.

17. A hockey stick comprising a shaft, and a blade structure having a center plane mounted to said shaft and elongated along a first axis, said blade structure having first and second opposed surfaces extending along said first axis and of formable material including a polymer resin and fibers, said blade structure including a multilayer element extending along said first axis, said multilayer element including at least a portion of said resin and first and second fibrous sheet elements disposed longitudinally with said opposed surfaces, said core element including an elongated insert and a peripheral frame member located in said center plane of said blade structure, said peripheral frame member defining an elongated opening in said center plane and said elongated insert being receivably seated within said elongated opening, and said blade structure being substantially non-deformable at a first normally ambient temperature and being formable at a second temperature greater than the first temperature and less than 250 degrees Fahrenheit.

18. A hockey stick according to claim 17, further comprising a hosel adapted for integrally mounting said shaft to said blade structure.

19. In a sports implement for attachment to a shaft, said implement being elongated along a first axis and having an attachment for assembly with the shaft, the improvement comprising a blade structure having a center plane extending along said first axis and of formable material including a polymer resin and fibers, said blade structure including a core element and a multilayer element extending along said first axis said multilayer element including at least a portion of said fibers and said resin, said core element including an elongated insert and a peripheral frame member located in said center plane of said blade structure, said peripheral frame member defining an elongated opening in said center plane and said elongated insert being receivably seated within said elongated opening, and said formable material being substantially non-deformable at a first temperature, said first temperature depending upon a characteristic of said polymer resin, and being formable at a second temperature greater than the first temperature.

20. In a sports implement according to claim 19, the further improvement wherein said first temperature is normal ambient temperature.

21. In a sports implement according to claim 19, the further improvement wherein said first temperature is 100 degrees Fahrenheit.

22. In a sports implement according to claim 19 the further improvement wherein said polymer resin is a thermoset resin.

23. In a sports implement according to claim 19 the further improvement wherein said polymer resin is a thermoplastic resin.

24. In a sports implement according to claim 19, the further improvement wherein said characteristic of said polymer resin is a glass transition temperature below 212 degrees Fahrenheit.

25. In a sports implement according to claim 24, the further improvement wherein said polymer resin includes an elastomeric compound for lowering the glass transition temperature of said polymer resin.

26. In a sports implement according to claim 25, the further improvement wherein said multilayer element comprises first and second fibrous sheet elements contiguous respectively with first and second opposed faces of said core element, said first and second fibrous sheet elements including first and second sets of fibers impregnated with resin, respectively.

27. In a sports implement according to claim 26, the further improvement wherein said first and second sets of fibers are symmetrically oriented with respect to a mid-plane of said core element located parallel to said faces of said core element.

28. In a sports implement according to claim 26, the further improvement wherein said first and second sets of fibers are asymmetrically oriented with respect to a mid-plane of said core element located parallel to said faces of said core element.

29. In a sports implement according to claim 19, the further improvement wherein said frame is positioned between a first and a second fibrous sheet element of said multilayer element.

30. In a sports implement according to claim 29, the further improvement wherein said insert is selected from the group of materials consisting of thermoplastic, fiber reinforced thermoplastic, thermoset plastic, fiber reinforced thermoset plastic, wood, plywood, and polymer resin foam.

31. In a sports implement according to claim 19, the further improvement wherein said fibers of said multilayer element are oriented at an angle of approximately forty-five degrees relative to said first axis.

32. In a sports implement according to claim 19, the further improvement wherein a major portion of said fibers of said multilayer element are oriented at an angle offset from said first axis by at least ten degrees.

33. In a sports implement according to claim 19, the further improvement comprising a plurality of holes extending within said multilayer element and filled with polymer resin.

34. In a sports implement according to claim 33, the further improvement wherein said polymer resin in said hole includes reinforcing fibers.

35. In a sports implement according to claim 19, the further improvement wherein the second temperature lies within a range between the first temperature and 250 degrees Fahrenheit.

* * * * *